United States Patent [19]

Lombardi

[11] 3,977,559

[45] Aug. 31, 1976

[54] LID FOR FOOD CONTAINER

[75] Inventor: Michael Lombardi, Piscataway, N.J.

[73] Assignee: Jerome Kreeger, South Orange, N.J. ; a part interest

[22] Filed: Oct. 30, 1972

[21] Appl. No.: 301,978

[52] U.S. Cl. ..... 220/90.4; 220/254; 220/306; 229/7 R; 229/43

[51] Int. Cl.² ..... A47G 19/22

[58] Field of Search ..... 229/7 R, 43; 220/27, 220/54, 90.6, 60 R, 90.2, 90.4, 306, 254; 215/46 H

[56] References Cited

UNITED STATES PATENTS

| | | | |
|---|---|---|---|
| 1,364,375 | 1/1921 | Isaacson | 229/7 R |
| 2,276,577 | 3/1942 | Hahn | 220/90.4 |
| 2,302,083 | 11/1942 | Wilcox | 229/7 R X |
| 2,330,840 | 10/1943 | O'Neil et al. | 229/7 R X |
| 2,719,663 | 10/1955 | Meyer-Jagenberg | 229/7 R |
| 2,839,234 | 6/1958 | O'Neil | 229/7 R |
| 3,298,590 | 1/1967 | Gray | 229/7 R |
| 3,301,459 | 1/1967 | Gardner | 229/7 R |
| 3,302,858 | 2/1967 | Miller | 229/7 R |
| 3,318,487 | 5/1967 | Edwards | 229/7 R X |
| 3,335,924 | 8/1967 | Miller | 229/7 R |
| 3,355,060 | 11/1967 | Reynolds et al. | 220/60 R |
| 3,421,654 | 1/1969 | Hexel | 220/60 R |
| 3,422,984 | 1/1969 | Foster | 220/60 R |
| 3,616,987 | 11/1971 | Krzyzanowski | 229/7 R |

*Primary Examiner*—William Price
*Assistant Examiner*—Allan N. Shoap
*Attorney, Agent, or Firm*—Lerner, David, Littenberg & Samuel

[57] ABSTRACT

A lid for a drink container is provided, which is adapted to fasten over the rim or lip of the container, and includes a flip-open section, such as a perforated section, which may be repeatedly opened and closed and extends inwardly from an edge of the lid and pivots on an inner portion of the lid. The edge of the flip-open section is adapted to fit on the lip of the container and includes a tab which aids in lifting up the flip-open section from the lip of the container and the remainder of the lid.

3 Claims, 4 Drawing Figures

LID FOR FOOD CONTAINER

FIELD OF THE INVENTION

The present invention relates to a lid for a container for drink or other foods and more particularly to a lid which includes a resealable flip-up section through which the contents of the container may be emptied.

BACKGROUND OF THE INVENTION

It is customary in filling carry-out orders for food and drink to utilize paperboard or plastic containers. The carry-out containers are usually provided with a lid or cover to prevent spillage and keep the contents thereof from being contaminated.

Lids heretofore employed generally consist of a circular disk which snap onto the lip or rim of the top of the container. The disk may include a tab for facilitating removal of the lid from the containers. Where the container is used for a cold drink, the lid may be provided with a breakable or cross-cut section through which a drinking straw may be inserted. However, where the container is used for a hot drink, such as coffee or soup, or for solid foods, it is necessary to completely remove the lid from the container to gain access to its contents. The lid, of course, can at anytime be placed back on the container to keep the contents thereof fresh and prevent spillage during temporary storage. However, as everyone has experienced at one time or another, it usually requires the use of both hands to replace the lid, without spilling the contents. This can be an onerous task, especially, when driving an automobile. Furthermore, where a container of hot drink is being consumed while sitting in a moving automobile, it is all but impossible to prevent jostling of the container with resulting spillage when the automobile is moving over a bumpy surface, is suddenly accelerated or is brought to an abrupt stop. Thus, a lid for carry-out containers which overcomes the above problems would be a most welcomed innovation.

DESCRIPTION OF THE INVENTION

In accordance with the present invention, there is provided a lid, especially adapted for use on a carry-out container, which helps overcome the problems attendant with the use of conventional type lids on such containers. The lid of the invention may be employed on containers carrying hot or cold foods, need never be fully removed from the container, provides easy access to the contents of the container while substantially eliminating spillage and is easily resealable. A portion of the inventive lid may be easily opened for access to the contents of the container and may be easily closed, with the use of only one hand. Thus, the lid of the invention is particularly useful as a cover for containers employed during an automobile trip.

The lid of the invention is adapted to fit over and close off the top of a container, said lid comprising a body portion which includes a severable or flip-open section which may be opened to gain access to the contents of the container and is resealable. The flip-open section is attached to and pivots on the body portion of the lid and extends from said pivot along two adjacent sides to a peripheral edge of the lid.

The sides of the flip-open section of the lid are defined by weakened areas, such as perforations, scoring, cuts or thin recessed lines (thinner than adjacent portions of the lid), so that upon lifting the outer edge of said section, such weakened areas can be severed and the entire section can be raised above the rest of the lid and pivoted about said pivot to define an opening in the lid. Usually the resulting opening in the lid will be large enought so that the user can drink the container contents directly through the lid, by applying his lower lip to the rim of the container. The opening will be sufficiently large to allow venting even during drinking thus facilitating consumption of the container contents and also to allow insertion of a spoon or other utensil for mixing. The body portion of the lid may include other weakened areas which may be punched out for further air access or for insertion of a straw.

The peripheral edge of the lid, including the edge of the flip-open section, may be corrugated or grooved for receiving the lip of the container. The lid may include more than one such corrugation or groove spaced from said peripheral edge so that the same size lid may be employed with various size containers.

Figure 2:
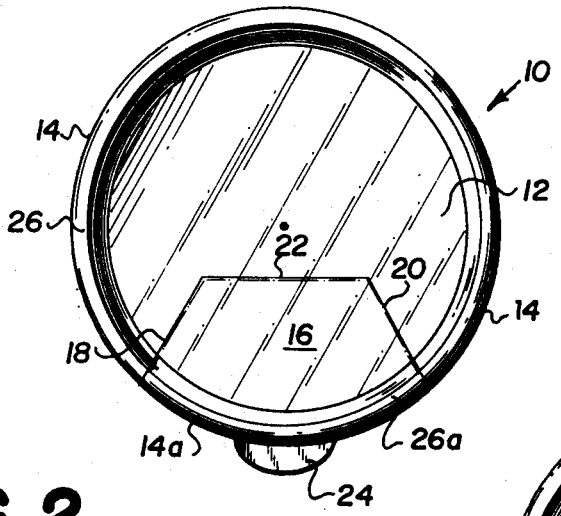
FIGS. 1 and 2 are plan views of two lids in accordance with the invention.

Referring to the drawings, wherein like numerals represent like parts in the several views, the numeral 10 represents a lid, generally, for a carry-out container, which includes a body portion 12 and a peripheral edge 14 and a flip-open section 16. The flip-open section 16 extends from peripheral edge 14a along sides 18, 20 to pivot 22 defined by the juncture of section 16 and body 12. As shown, the sides 18, 20 are perforated or scored so that upon lifting the edge **14*a*, the sides 18, 20 are easily severed from the body portion 12 and the flip-open section 16 can be pivoted along pivot 22 to form an opening in the lid. The flip-open section 16 includes a tab 24 to facilitate lifting of the edge 14*a*** from the rim of the container.

The peripheral edge **14*a* of the flip-open section 16 as well as the peripheral edge 14 of the body portion 12 of the lid 10 include annular groove or annular corrugation 26*a* and 26, respectively, for receiving the lip of the container. The annular groove 26 and 26*a*** ensures secure fastening of the lid to the rim of the container and resealing of the flip-open portion to said container rim.

Figure 3:
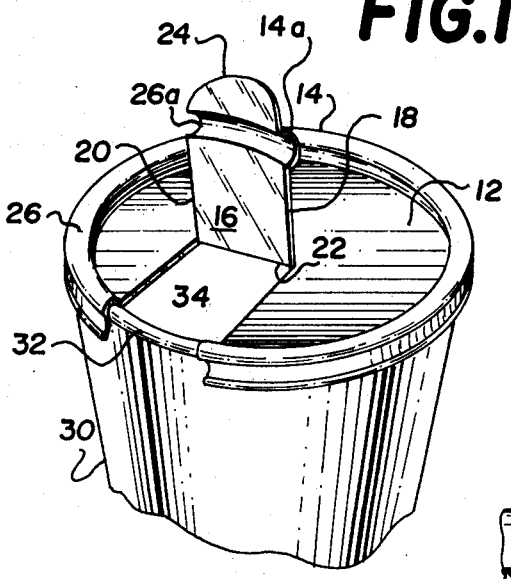
FIG. 3 is a perspective view of the lid of FIG. 1 fastened to the rim of a container showing the peripheral edge of the lid.
Figure 4:
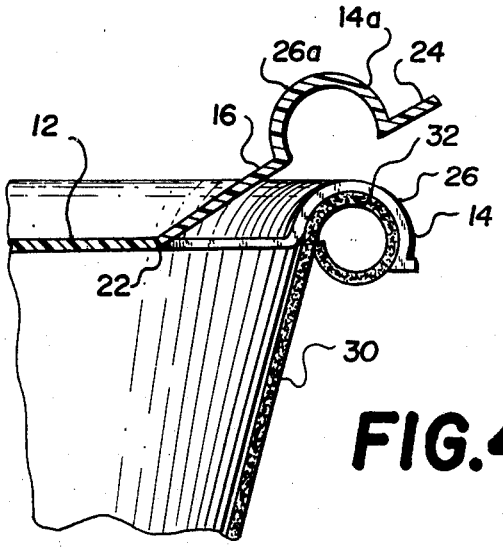
FIG. 4 is a side cross-section of the lid fastened to a container.

The lid 10 of the invention as shown in the Figures may be used as follows. A container 30 (shown in FIG. 3) is normally filled to a level below the rim 32. When the container is to be carried from one location to another, the lid 10 is applied to the rim 32 by inserting the annular peripheral groove **26, 26*a* over the rim 32. With the lid in position, flip-open section is coplanar with the body portion 12 of the lid. When access to the contents of the container 30 is desired, the tab 24 is lifted thereby removing the peripheral edge 14a of said flip-open section 16 from the rim 32 of container 30 to form opening 34 of said lid; this lifting motion is continued thereby severing sides 18, 20 from the body portions 12 up to the pivot 22. The flip-open section 16 can be bent back on pivot 22 past the vertical to insure that it (section 16) will maintain its opened period during consumption of the container contents. Where it is desired to set down the container for temporary storage, the flip-open section can be pivoted back about pivot 22 and the peripheral edge thereof 14***a* secured, via annular groove 26*a*, to rim 32 of the container 30. This action will substantially reseal the lid 10 so that the flip-open portion and body portion 12 are substantially coplanar.

Figure 1:
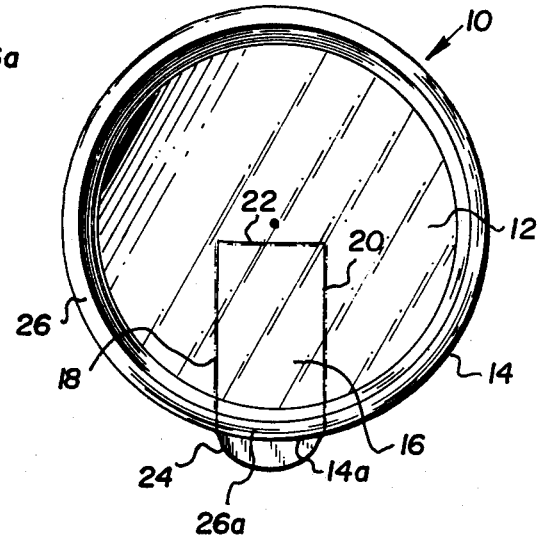

The flip-open section 16 can be formed to have any desired configuration, such as shown in FIGS. 1 and 2, so long as the section 16 can be easily opened and pivoted about pivot 22, without snapping off the body portion 12, and can be resealed. The sides 18, 20 can extend from the peripheral edge of the lid back past the central portion of the lid. Furthermore the pivot 22, as shown in FIG. 2 can extend almost to the edges of the lid. The pivot 22 can be scored or includes a thin recessed line to aid in bending the flip-open section back about the pivot.

In one embodiment of the invention, the pivot 22 may extend to the peripheral edges 14 of the lid 10. In this embodiment, sides 18, 20 will not be present and access to the container contents may be had by simply bending the flip-open section 16 about pivot 22.

Resealing of the flip-open section is accomplished by pivoting the section back about pivot 22 and fastening the edge of the section to the rim 32 of the container as described hereinbefore.

The lid of the invention may be formed of any conventional lid material, such as plastics, paperboard, cardboard and the like, so long as the material is sufficiently strong to allow pivoting of a portion thereof about the remainder. It is apparent that the lids contemplated herein will be relatively thin in cross-section. Thus, repeated pivoting of the flip-open section may cause weakening of the pivot and even severing of the flip-open section from the remainder of the lid. However, in normal use, the flip-open section will not be severed.

What is claimed is:

1. A reusable circular lid adapted to fit on and be fastened by hand over the rim of a container, said lid being of one piece construction and comprising a circular body portion which is substantially flat, said body portion including an annular groove or corrugation about the periphery thereof for fastening said lid to the rim of a container, a substantially flat pivot and a substantially flat flip-open section which extends away from a peripheral edge of the lid to said pivot, said pivot being defined by the juncture between said flip-open section and said body portion, said flip-open section being adapted to be repeatedly opened or closed to seal said container by pivoting said flip-open section about said pivot, said pivot being integral with said body portion and spaced from said peripheral edges of said body portion and stopping short of the geometric center of said circular lid, said flip-open section being capable of being supported at said pivot and by its own weight when in its open position, said flip-open section further being defined by the peripheral edge of said lid, said pivot and a pair of sides of said flip-open section linking said edge and said pivot, said pair of sides being spaced from the peripheral edges of said body portion and are defined by weakened areas to facilitate severing of said sides from said body portion.

2. The lid in accordance with claim 1 wherein said sides are defined by perforations or scoring.

3. The lid in accordance with claim 1 including a tab affixed to a peripheral edge of said flip-open section for facilitating lifting of the periphery of said section and severing the sides thereof from the body portion of the lid.

* * * * *